US010441987B2

(12) United States Patent
Baum

(10) Patent No.: US 10,441,987 B2
(45) Date of Patent: Oct. 15, 2019

(54) DEVICE AND METHOD FOR BENDING PIPES FOR PIPELINES

(71) Applicant: Maats Beheer B.V., St Goor (NL)

(72) Inventor: Oliver Baum, Hannover (DE)

(73) Assignee: Maats Beheer B.V., St Goor (NL)

( * ) Notice: Subject to any disclaimer, the term of this patent is extended or adjusted under 35 U.S.C. 154(b) by 314 days.

(21) Appl. No.: 14/408,888

(22) PCT Filed: Jun. 14, 2013

(86) PCT No.: PCT/EP2013/001762
§ 371 (c)(1),
(2) Date: May 26, 2015

(87) PCT Pub. No.: WO2013/189582
PCT Pub. Date: Dec. 27, 2013

(65) Prior Publication Data

US 2015/0266075 A1 Sep. 24, 2015

(30) Foreign Application Priority Data

Jun. 20, 2012 (DE) ..... 10 2012 012 139

(51) Int. Cl.
*B21D 9/00* (2006.01)
*B21D 9/01* (2006.01)
*B21D 39/20* (2006.01)

(52) U.S. Cl.
CPC ..... *B21D 9/00* (2013.01); *B21D 9/01* (2013.01); *B21D 39/20* (2013.01)

(58) Field of Classification Search
CPC ..... B08B 9/049; F16L 2101/40; B21D 9/073; B21D 9/03; B21D 9/01; B21D 11/00;
(Continued)

(56) References Cited

U.S. PATENT DOCUMENTS 3,382,698 A * 5/1968 Anderson ..... B21D 9/03 72/298
4,007,622 A * 2/1977 Galperin ..... B21D 9/14 72/369
4,352,285 A * 10/1982 LaRue ..... B21D 9/03 72/398

FOREIGN PATENT DOCUMENTS

DE 102008060897 A1 * 6/2010 ..... B21D 9/05

OTHER PUBLICATIONS

DE102008060897A1 is attached.*
Machine translation of DE102008060897A1 is attached.*

* cited by examiner

*Primary Examiner* — Peter Dungba Vo
*Assistant Examiner* — Joshua D Anderson
(74) *Attorney, Agent, or Firm* — The Webb Law Firm

(57) ABSTRACT

The invention relates to a device for bending pipes, in particular coated pipes, in a preferred manner insulated pipes and/or pipes that are coated with PU foam/PUR rigid foam, for pipelines, said device having a basic body which can be positioned in the pipe and on which a running gear unit is provided for movement in the pipe and having at least three contact elements for producing a contact with an inside wall of the pipe for introducing a bending force, wherein at least two contact elements are provided on one side of the basic body on the ends of the basic body, and at least one contact element is arranged on the opposite side of the basic body, and wherein at least one of the contact elements is provided so as to be movable in relation to the basic body in the direction of the inside wall of the pipe by means of a force-introducing element. In addition the invention relates to a method for bending such pipes.

6 Claims, 12 Drawing Sheets

Figure 1:
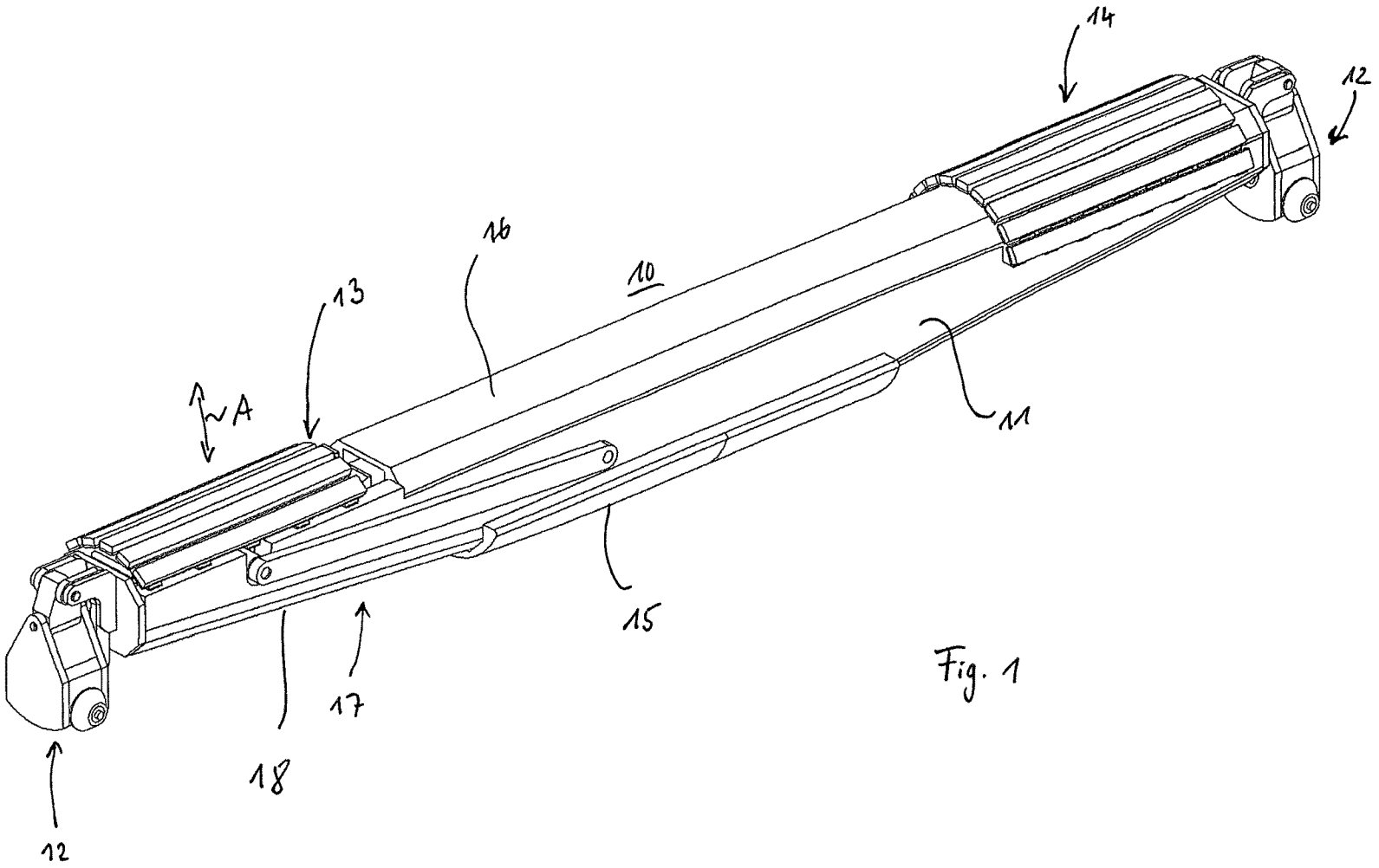

(58) Field of Classification Search
CPC ..... B21D 7/025; B21D 43/006; B21D 9/00;
B21D 26/033; B21D 7/00; B21D 39/20;
B21D 11/22; B29C 66/71; B29C 47/0023
See application file for complete search history.

DEVICE AND METHOD FOR BENDING PIPES FOR PIPELINES

The invention relates to a device for bending pipes, in particular coated pipes, in a preferred manner insulated pipes and/or pipes that are coated with PU foam/PUR rigid foam, for pipelines, said device having a basic body which can be positioned in the pipe and on which a running gear unit is provided for movement in the pipe and having at least three contact elements for producing a contact with an inside wall of the pipe for introducing a bending force, wherein at least two contact elements are provided on one side of the basic body on the ends of the basic body, and at least one contact element is arranged on the opposite side of the basic body, and wherein at least one of the contact elements is provided so as to be movable in relation to the basic body in the direction of the inside wall of the pipe by means of a force-introducing element. In addition the invention relates to a method for bending such pipes.

Said pipes are used in the case of pipes such a pipelines which conduct large amounts of fluids or gases over large distances. The transported media are, among other things, crude oil, chemicals and/or drinking water.

Pipes for conducting both fluid and gaseous materials over large distances exist all over the world. Said pipelines are generally speaking composed of portions of individual pipes which are between 12 and 18 meters in length. The pipes comprise, in the majority of cases, a diameter of between 4 and well in excess of 75 inches and are laid, welded together to form a pipeline, on the surface of the ground, underground and/or in water. Frequently, the pipelines follow the general contour of the surface of the ground. The course of the pipelines can also be diverted in its horizontal and vertical extension or routed around obstacles in another manner.

A large challenge when planning and constructing these types of pipelines is to join the ends of the individual pipes using good quality welded joints. In order to follow the contour of the surface of the ground and to bypass any obstacles in the course of the pipelines, changes in direction in the pipeline are necessary. When generating the changes in direction, extensive attempts are made to dispense with welded joints. Changes in direction in pipelines, precisely in the case of large diameter pipes, can be generated as a result of welding individual pipe sections. In order to minimize the number of welded joints and consequently to increase the reliability of the pipelines, the change in direction in the pipe has to be generated by means of bending the pipe.

As is usual in the case of large diameter pipes, a bend is obtained by carrying out numerous small, arranged bending steps in the pipe. The desired bending radius is therefore generated in the form of a polygon. In the case of such a bending system, the operator has total control of the number of incremental and/or gradual bends to be generated, of the distance between the incremental and/or gradual bends and of the dimension of each incremental and/or gradual bend in the pipe. Experienced operators can control the pipe bending machines efficiently in order to generate precise bends in the pipes and at the same time minimize the number of damaged or wrongly bent pipes which result in time and raw materials, such an energy and pipes, being wasted.

After each bending operation, the pipe and the bending device have to be moved relative to one another in a highly precise manner. In this case, it is possible for both the pipe to move in the bending device and the bending device itself to move. The disadvantage of the last variant is that the pipe has to be aligned anew in the bending device. The moving of large diameter pipes, the precise displacement of the punch and the control of the generated bend are linked to a high level of expenditure on personnel and a large power requirement.

On account of the size of the pipes to be bent, bending devices are generally of the enormous type and are operated hydraulically. A bending device is known in general from U.S. Pat. Nos. 3,834,210 and 5,092,150. Such bending devices have devices for gripping the pipe, for moving the pipe in the bending device and for generating the bend in the pipe. Said devices are all hydraulically operated under the control of an operator.

Document DE 600 28 484 T2 shows a conventional bending device which is adapted for generating bends in a large diameter pipe. Generally speaking, the bending device includes a reinforced frame on which the components are anchored against relative movement. The main components of the pipe bending device include a bending tool, a punch, also called a mandrel, a supporting device and a fastening shoe. The bending tool is a fixed body which is stationary with reference to the frame and has a curved face which faces the pipe, the bending tool being pressed against the pipe during the bending operation. The supporting device is actuated by a hydraulic pressure during the bending operation and is pivoted in the direction of the bending tool. The fastening shoe fixes the pipe in the meantime. In the operating regions of the bending device, forces are transmitted to the pipe during the bending operation by means of the bending tool, the supporting device and the fastening shoe, such that said pipe is deformed. The mandrel is a rigid structure provided with members which makes it possible for the pipe to be bent without altering the circular manner of the pipe at the bending point. These types of mandrels are known in the prior art.

As the abovementioned bending device has already shown, bending devices usually comprise three operating regions in which the forces necessary for bending the pipe are transmitted to the pipe. During the bending operation, force is actively introduced in one operating region by means of a hydraulic cylinder. The remaining passive operating regions serve as abutment and are connected to the active operating region by means of the frame. DE 696 03 499 T2 shows a bending device where the central one of the three operating regions is realized as an active operating region.

Large forces have to be applied for bending these types of large diameter pipes. The necessary bending devices and the mandrel have to be realized in a correspondingly large and solid manner. The equipment required for using these types of large bending devices, such as, for example, diesel units, hydraulic pumps and mandrels is also large in volume and weight. Overall it can be seen that the operation of these types of bending devices makes great demands on the space required during transport and at the site of use. The costs of consumables, in particular fuels and energy sources, are added to the high costs of the logistics.

Reducing expenditure on personnel, a method for automating a bending device and a control system with a programmable processor is known additionally from DE 600 28 484 T2. Automation is necessary precisely in order to carry out incremental and/or gradual bending processes with a high degree of repeatability. With a higher quality, the duration of the entire bending operation should be shortened and thus at the same time the transported weight and the power requirement of the bending device should be reduced.

A device named in the introduction and a corresponding method are known from DE 10 2008 060 897. A bending device which can be positioned entirely in the interior of the pipe to be bent, at least with its parts that are essential for the operation of the bending machine, is provided in this case. As a result, it is possible for the bending device to apply the forces necessary for bending the pipe from the inside on the pipe. As a result, it is possible, on the one hand, to dispense with a punch and/or a mandrel as the bending device itself supports the inner form of the pipe at the same time and generates the bending in the pipe. This results in a small amount of expenditure on personnel and also in a small energy requirement. In addition, damage to a coating applied on the outside of the pipe, for example paint, insulation and/or synthetic resin strengthening, is avoided in principle as a result.

JP 58138523 A also makes known a bending device which carries out the bending in the interior of the pipe. In this case, there are two active operating regions present (front and rear) whereas the central operating region is realized in a passive manner. The precise introduction of force onto the two separate operating regions is disadvantageous in this case.

It is favorable, which also applies to the following solution according to the invention, for at least three contact elements to be provided on the carrier of the bending device, two contact elements being arranged on a first side of the carrier on the ends of the carrier and one contact element being arranged on a second side of the carrier opposite the first side in the center of the carrier. As a result, it is possible for the bending device to be movable inside the pipe like a rocker. Over and above this, it is favorable for the contact elements to be able to be positioned on the inside top surface of the pipe in particular in a positive locking manner. As a result, it is possible for the bending device to adapt to the inside top surface of the pipe when the forces necessary for bending are introduced into the pipe and thus damage to the pipe is avoided. The contact elements, according to one teaching of the invention, also consist of a type of rubber, hardwood, an aluminum alloy and/or a plastics material with an appropriate Shore hardness.

Said device is worthy of improvement with regard to the bending precision, in particular with reference to coated pipes.

The object underlying the invention is to create a bending device by way of which coated pipes can be bent with greater precision.

With reference to the device, the object according to the invention is achieved in a first solution as a result of the force-introducing element being arranged substantially horizontally such that force is introduced horizontally, and as a result of a path-diverting element being provided that is realized such that the horizontally introduced force brings about a substantially vertical movement of the contact element toward the inside wall of the pipe.

As a result, the necessary introduction of force can be optimized and it is possible to carry out the bending in a more precise manner in this way.

A further teaching of said solution provides that the running gear unit is arranged in such a manner on the basic body that the basic body is rotatable in relation to the running gear unit and that the direction of rotation is effected in a substantially perpendicular manner with reference to the direction of travel. As a result, the necessary alignment of the device in the pipe can be optimized and it is possible to carry out the bending in a more precise manner in this way. It is possible to align the device in relation to the force of gravity, as a result of which deviations from the displacement path can be compensated, as a result of which it is possible to bend precisely in one plane.

A further teaching of the invention provides for providing the second contact element so as to be movable in relation to the basic body in the direction of the inside wall of the pipe by means of a force-introducing element and for a further contact element to be provided on the basic body on the opposite side to the second contact element, realized in a preferred manner integrally with the opposite contact element which extends in a particularly preferred manner up to the end of the basic body on which the second contact element is arranged. It has been shown that such an arrangement results in the pipeline being bent in a particularly precise manner.

With reference to the device, the object according to the invention is achieved in a second solution as a result of the running gear unit being arranged on the basic body such that the basic body is rotatable in relation to the running gear unit and that the direction of rotation is effected in a substantially perpendicular manner with reference to the direction of travel.

As a result, the necessary alignment of the device in the pipe can be optimized and it is possible to carry out the bending in a more precise manner in this way.

A further teaching of said solution provides that the force-introducing element is arranged substantially horizontally such that force is introduced horizontally, and that on one end of the force-introducing element at least one path-diverting element is provided that is realized such that the horizontally introduced force brings about a substantially vertical movement of the contact element toward the inside wall of the pipe. As a result, the necessary introduction of force can be optimized and it is possible to carry out the bending in a more precise manner in this way.

A further teaching of the invention provides for providing the second contact element so as to be movable in relation to the basic body in the direction of the inside wall of the pipe by means of a force-introducing element and for a further contact element to be provided on the opposite side to the second contact element on the basic body, realized in a preferred manner integrally with the opposite contact element which extends in a particularly preferred manner up to the end of the basic body on which the second contact element is arranged. It has been shown that such an arrangement results in the pipe being bent in a particularly precise manner.

With reference to the device, the object according to the invention is achieved in a third solution as a result of the second contact element being provided so as to be movable in relation to the basic body in the direction of the inside wall of the pipe by means of a force-introducing element and as a result of a further contact element being provided on the basic body on the opposite side to the second contact element.

As a result, it is possible to align the device in the pipe in an optimum manner with reference to the desired bending angle and to secure it and then to carry out the bending step in an optimized manner with the first contact element.

A further teaching of the invention provides that the contact element which is located opposite the second movable contact element is realized integrally with the opposite contact element which extends in a preferred manner up to the end of the basic body on which the second contact element is arranged.

In addition, it is advantageous for the force-introducing element to be arranged substantially horizontally such that force is introduced horizontally, and for on one end of the force-introducing element there to be provided a path-diverting element which is realized such that the horizontally introduced force brings about a substantially vertical movement of the contact element toward the inside wall of the pipe. As a result, the necessary introduction of force can be optimized and it is possible to carry out the bending in a more precise manner in this way.

A further teaching of the invention provides that that the running gear unit is arranged on the basic body such that the basic body is rotatable in relation to the running gear unit and that the direction of rotation is effected in a substantially perpendicular manner with reference to the direction of travel. As a result, the necessary alignment of the device in the pipe can be optimized and it is possible to carry out the bending in a more precise manner in this way.

The following, advantageous teachings provide advantageous embodiments for all three solutions of the object according to the invention.

A further teaching of the invention provides that the path-diverting element comprises a wedge-shaped element and an element which corresponds to the wedge-shaped element on the movable contact element and is arranged so as to be movable on the wedge-shaped element. As a result, the introduction of force can be effected horizontally, as a result of which a structurally larger force-introducing element with a greater lifting height and a smaller diameter can be used, whilst at the same time the necessary precision for the introduction of force can be provided. The providing of the wedge-shaped element as a component part of the path-diverting element, in this case, provides a particularly simple but effective embodiment. In addition, as a result of the wedge-shaped element, the transmittable force is increased corresponding to the wedge angle.

A further teaching of the invention provides that the movable contact element is movably connected to the basic body by means of a connecting element which is pivotally mounted on the contact element, in a preferred manner a cantilever arm or a steel cable, and in a preferred manner the connecting element is pivotally mounted on the basic body so as to be rotatable, and/or that at least one return element, in a preferred manner a spring element, is provided between the movable contact elements and the basic body. As a result of the return element, the overall structure of the device is simplified as the force-introducing element has to transmit force only in one direction.

A further teaching of the invention provides that on a side of the force-introducing element opposite the path-diverting element, in each case on the force-introducing element and in a corresponding manner on the basic body, a pressing face is present in each case as an abutment for introducing the force, which pressing faces come into contact when force is introduced, and/or that the force-introducing element is a hydraulic cylinder.

With reference to the hydraulic cylinder, it is advantageously possible for the necessary forces to be generated outside or inside the pipe by a hydraulic pump and to be guided by means of pipe and/or hose lines to exposed contact faces in order to transmit the forces onto the pipe there by means of the hydraulic cylinders which are to be arranged in a space-saving manner. In this case, the number of hydraulic cylinders can be chosen corresponding to the forces necessary for the bending. It is particularly useful to arrange the hydraulic cylinders on one and/or on both ends of the carrier as in this way a large bending torque can be generated with relatively small forces by means of the long lever arm of the bending device.

A further teaching of the invention provides that the running gear unit comprises a running gear unit basic body which is rotatable in relation to the basic body, and/or that the running gear unit comprises a front and a rear running gear unit and the rotational axes of the running gear unit bodies of the running gear units extend coaxially, wherein in a preferred manner the rotational axis is arranged such that it is situated above the center of gravity of the device and/or of the running gear unit.

A further teaching of the invention provides that the running gear unit comprises a body which comprises wheels for propelling the device in the pipe and which is movable in relation to the running gear unit basic body to the rotational axis of the running gear unit basic body, in a preferred manner by means of at least one hydraulic cylinder. The space necessary for bending up the pipe is generated in a simple manner as a result of raising the wheels.

It is advantageous for the contact elements to comprise a suspension system which is realized in particular as a leaf spring. As a result, it is possible to position the contact elements onto the pipe in a damped manner. It is also possible for the contact elements to adapt to the surface geometry of the pipe, which results in the bending device being held more securely and the material of the pipe being protected. In this case, it is particularly favorable for the bending device and/or at least one contact element to be developed with the geometry of a bending angle and/or bending radius of the pipe to be generated by means of the bending device. As a result, it is possible for the region of the pipe to be bent to abut against the operating region, as a result of which warping, folding or other unwanted deforming of the pipe can be avoided. Said operating region is pre-deformed corresponding to the geometry of the bend to be generated.

It is advantageous for the bending device to comprise a convex geometry in its longitudinal extension. As a result, it is possible for the bending device to be able to move even in the curved pipe. In this case, the geometric realization of the bending device is based on the minimum admissible bending radius for large pipes in dependence on the diameter of the pipe.

With reference to the method, the object according to the invention is achieved by a method for bending pipes, in particular coated pipes, in a preferred manner insulated pipes and/or pipes that are coated with PU foam, for pipelines, said method comprising the steps: locally fix a first end of the pipe to be bent, movably support an opposite end of the pipe to be bent, move a bending device, in a preferred manner according to a device described previously, into an interior of the pipe to be bent and move the bending device through the pipe. Arrange the bending device at the first bending location, raise the running gear unit, record the current bending angle of the pipe, activate the force-introducing element, extend the movable contact element against the inside wall of the pipe, continue the movement of the contact element against the inside wall of the pipe up to the bending angle that is necessary at the bending point, retract the contact element, extend the running gear unit, move to the next bending point and repeat the bending.

A further teaching of the invention provides that once the running gear unit, which is situated further in the pipe, has been raised, the downwardly pointing contact element rests on the inside wall of the pipe and the second movably realized contact element is extended against the inside wall of the pipe such that the bending device is wedged on one side in the pipe.

A further teaching of the invention provides that whilst the pipe is being passed through, the path is recorded, in a preferred manner per angular momentum of the wheels of the running gear unit or by means of a cable sensor as a distance measurement between the bending device and the end of the pipe on the inlet side, and/or that during the lowering of the front running gear unit the distance to the inside wall of the pipe is monitored, and/or that the necessary bending angle is composed of the bending angle to be achieved at the bending location and an angle which is produced from the elasticity of the pipe to be bent.

A further teaching of the invention provides that that the basic body of the bending device is aligned against the force of gravity at the respective bending location.

Figure 2:
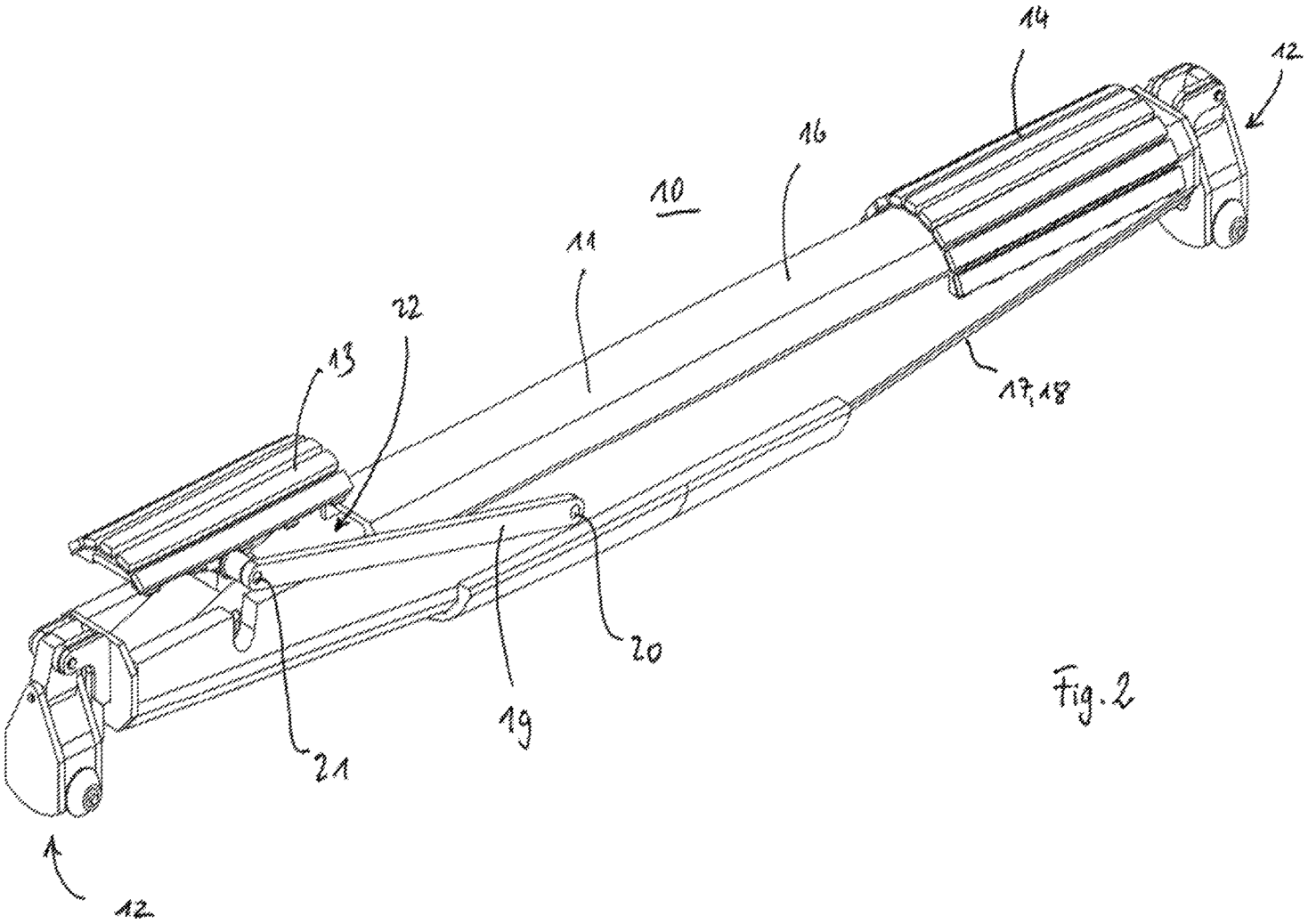
Figure 3:
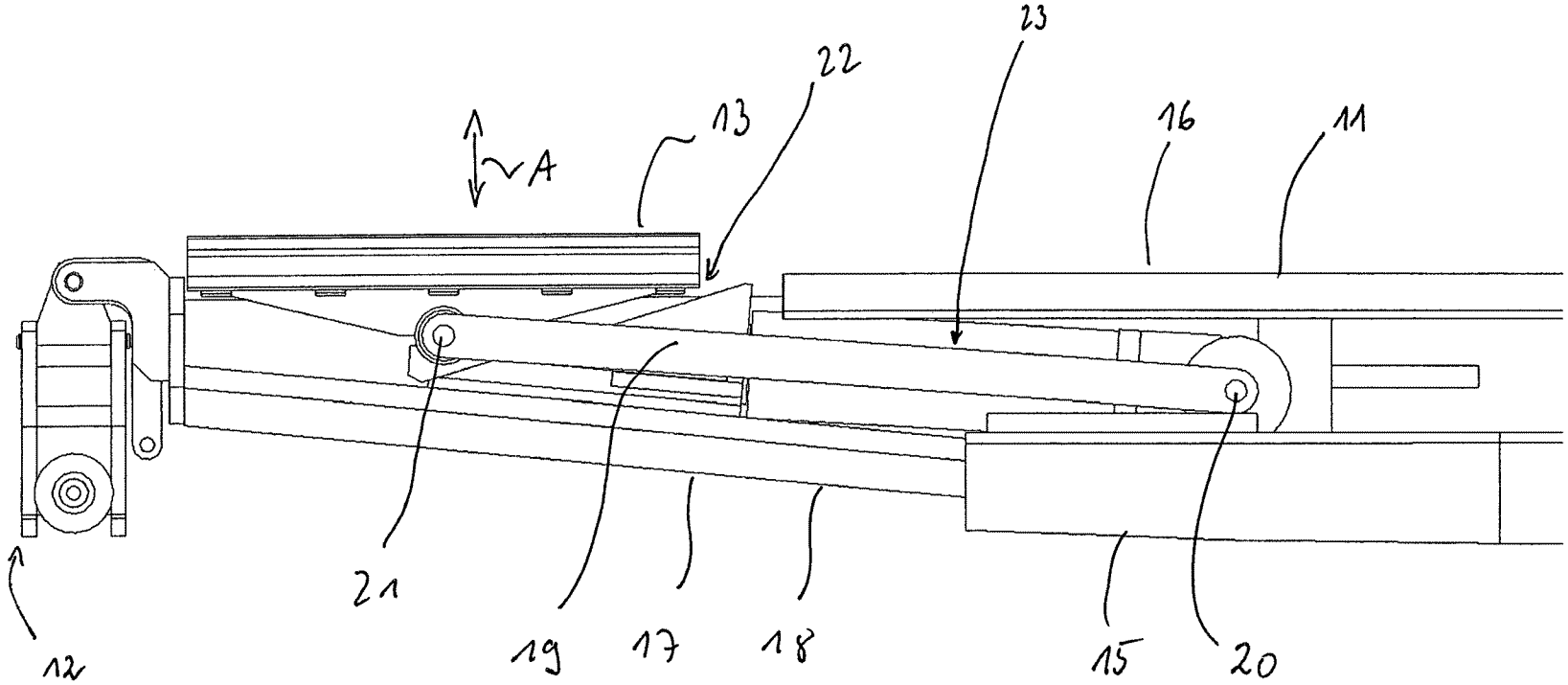
Figure 4:
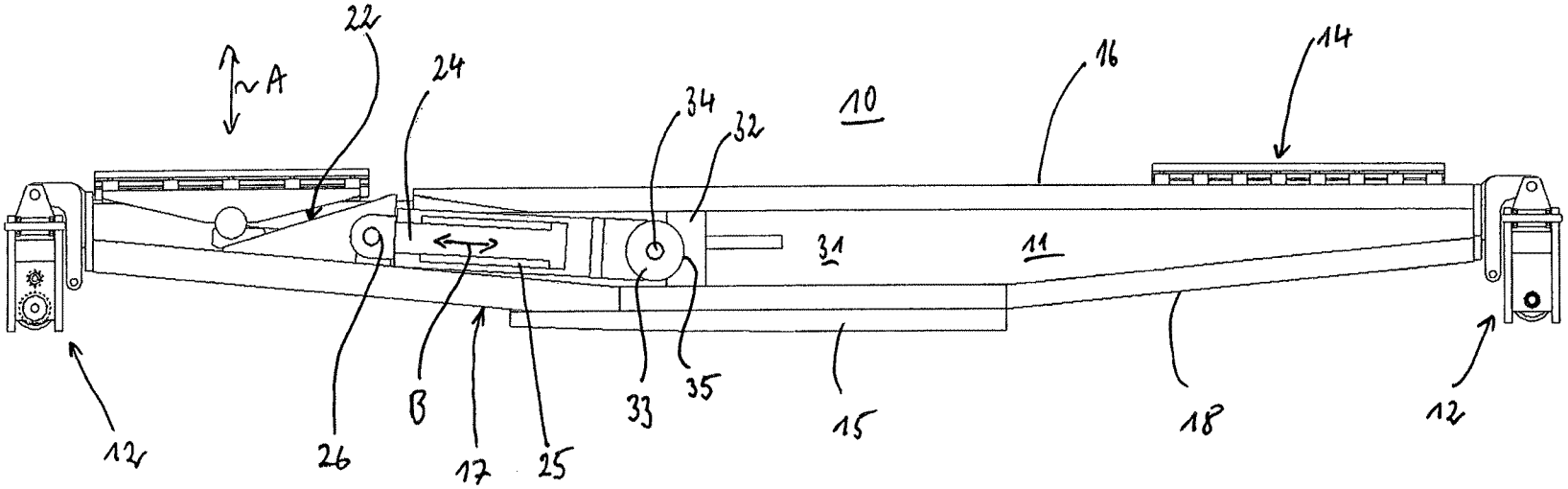
Figure 5:
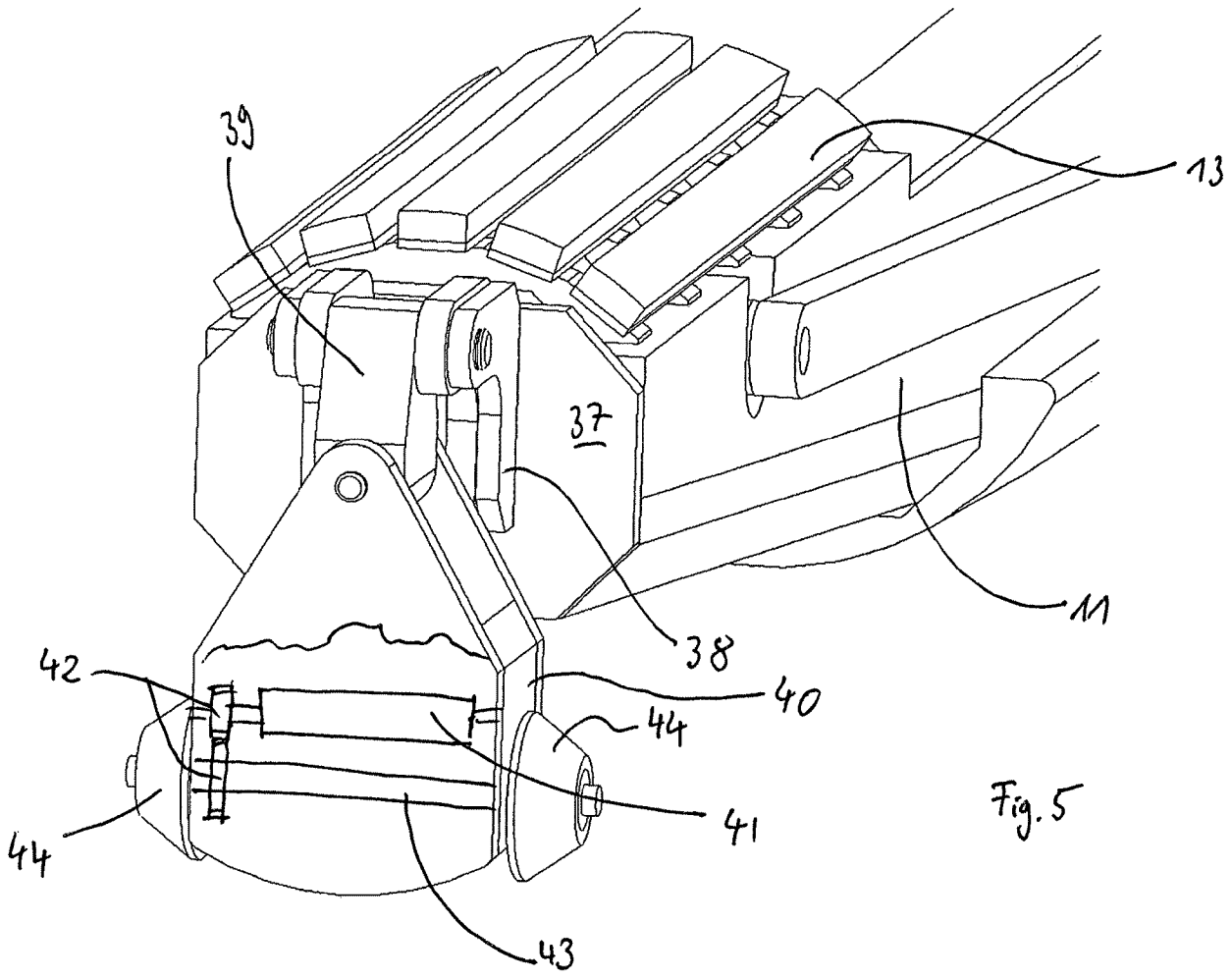
Figure 6:
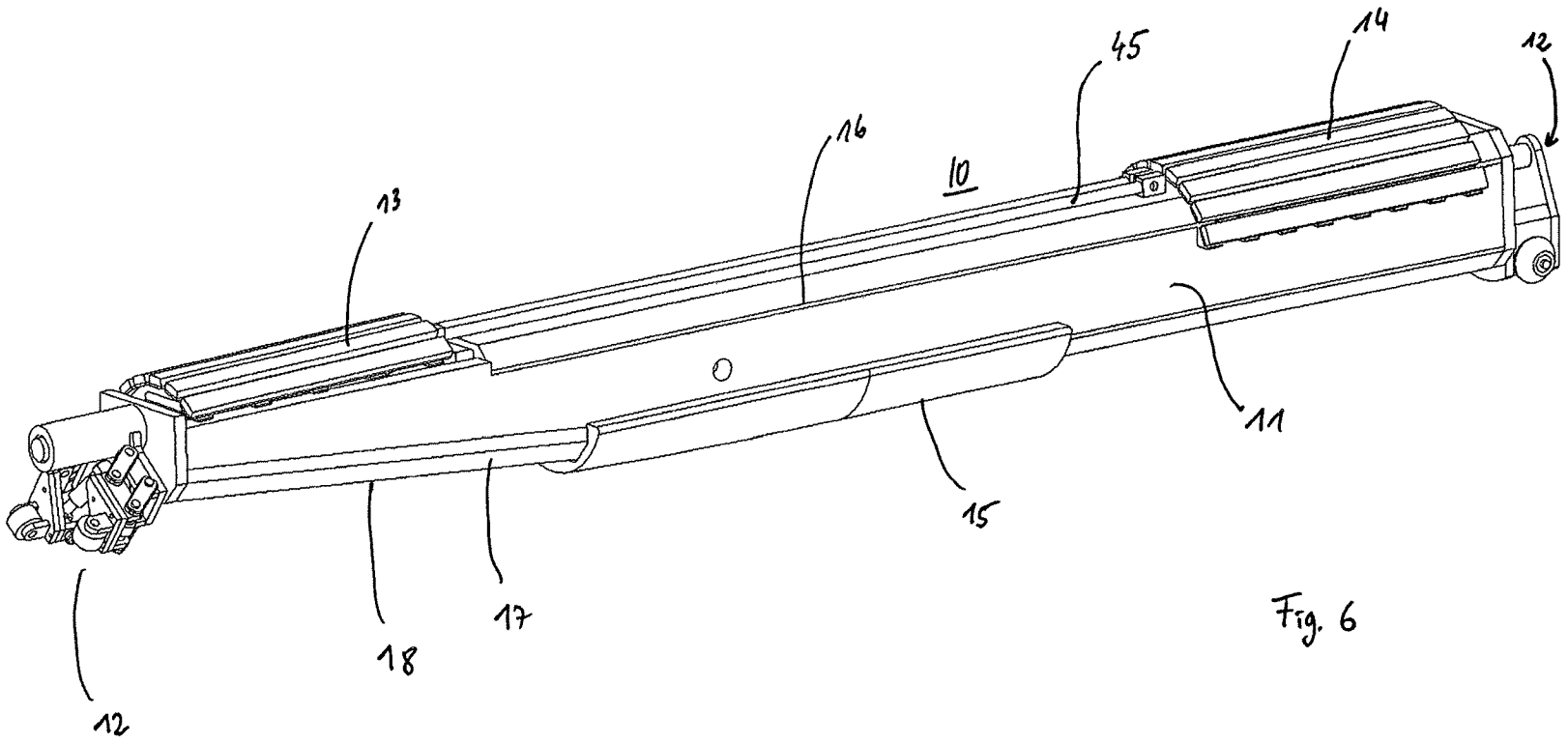
Figure 7:
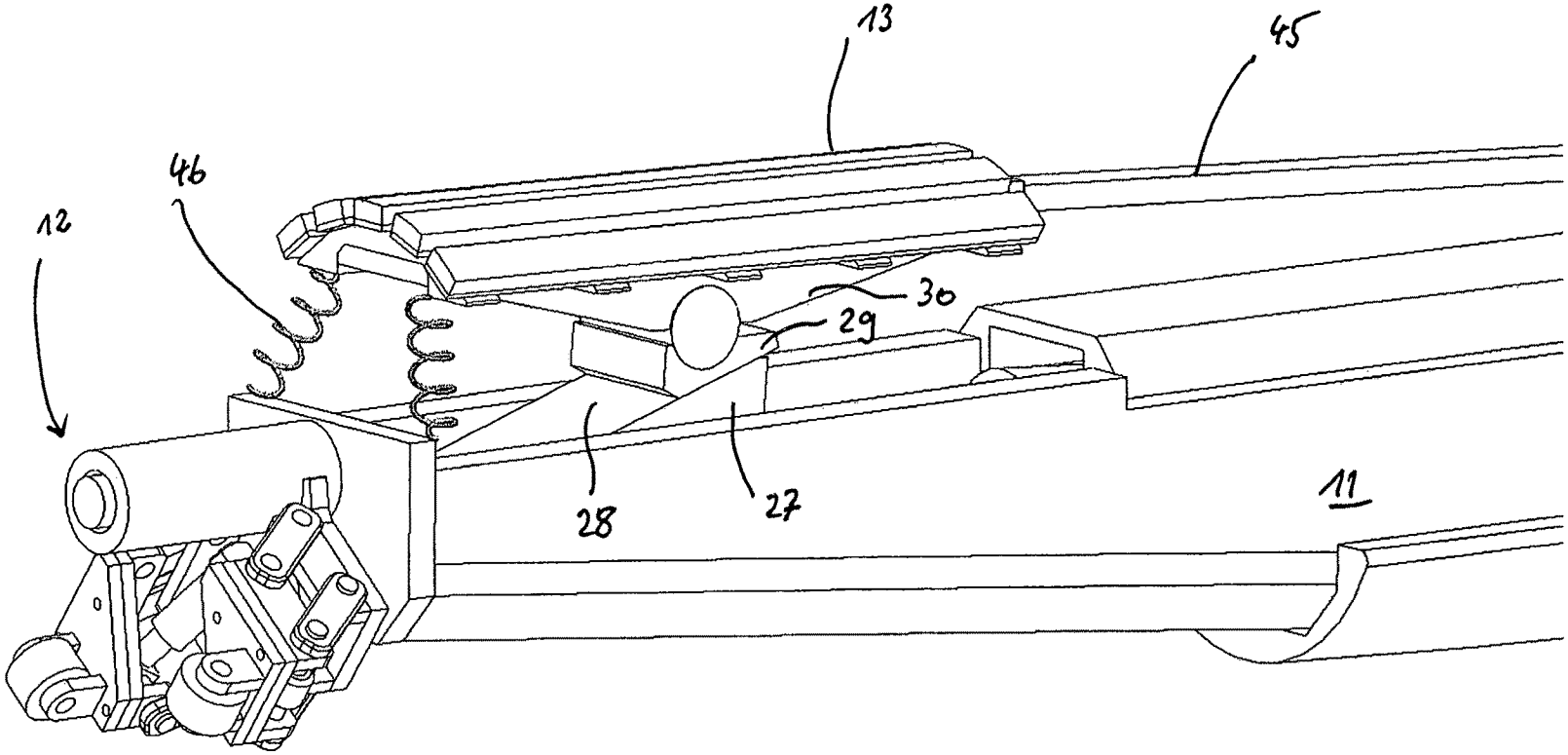
Figure 8:
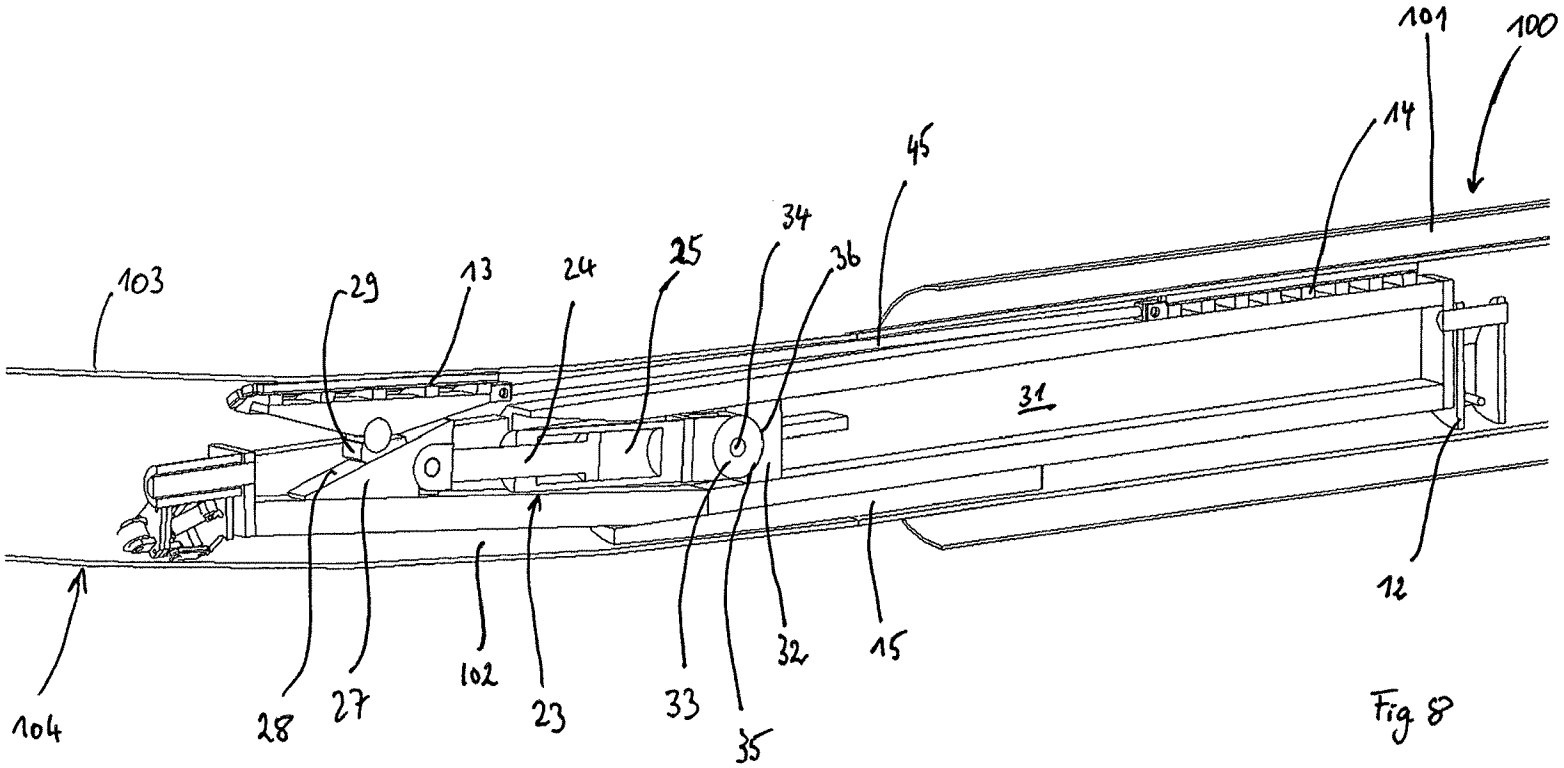
Figure 9:
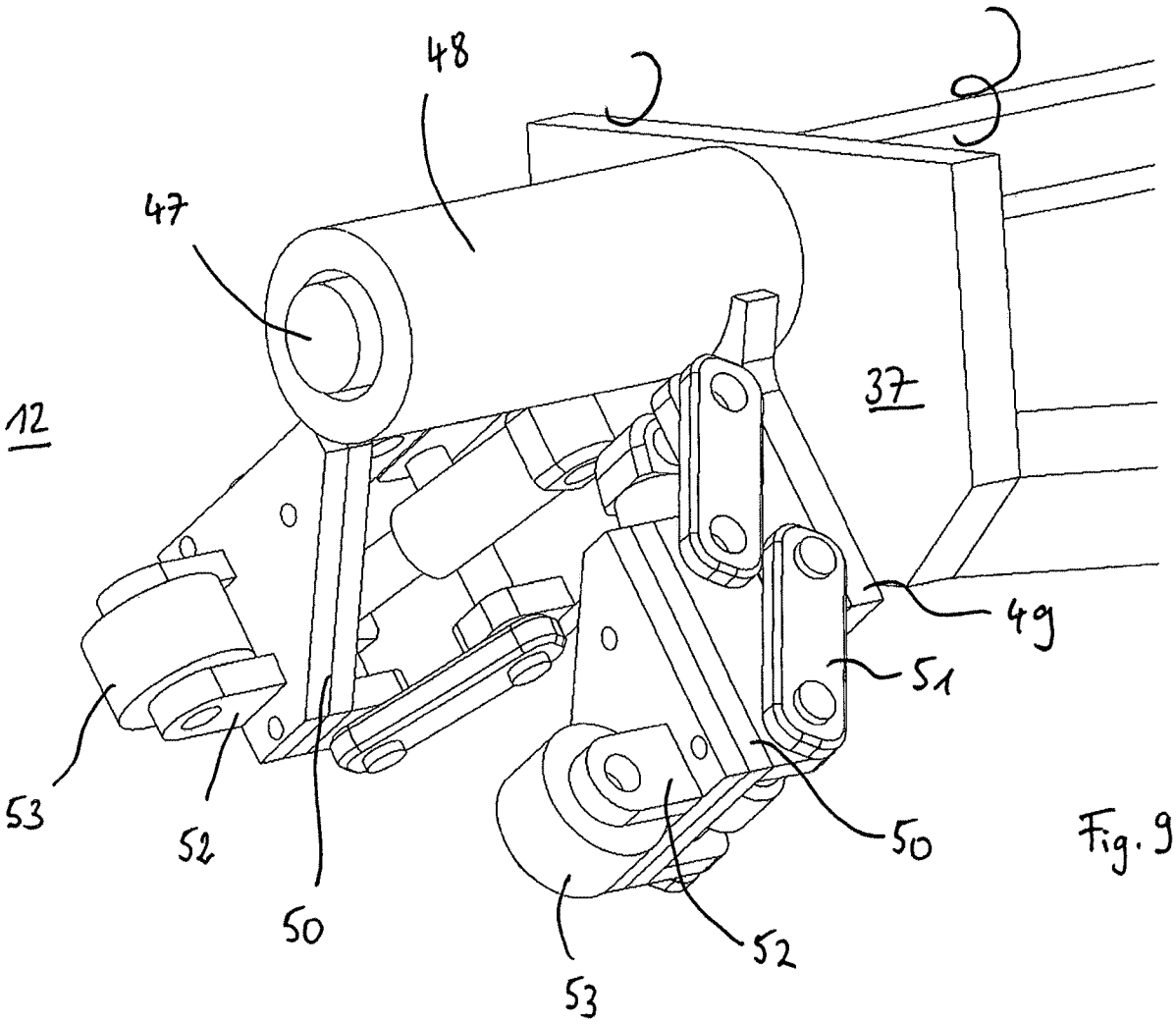
Figure 10:
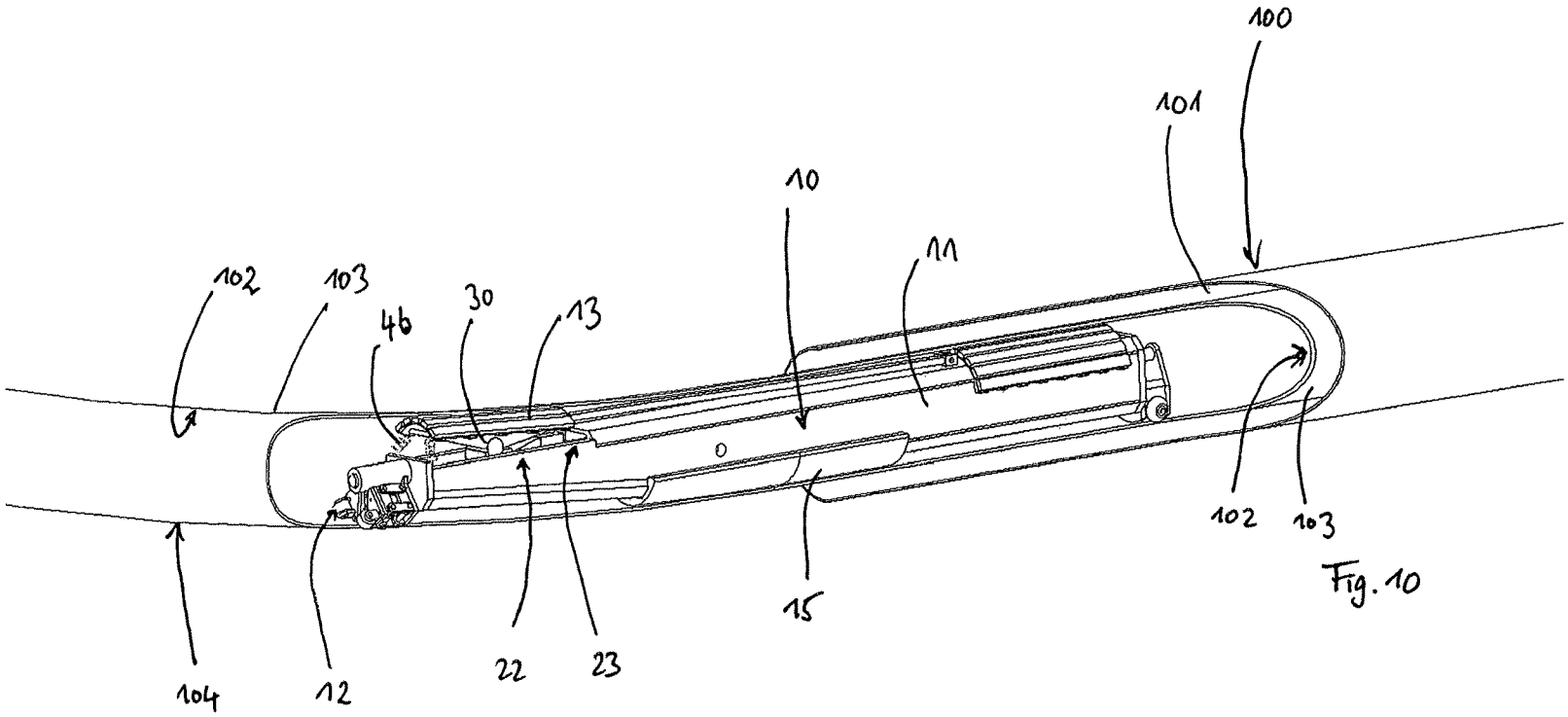
Figure 11:
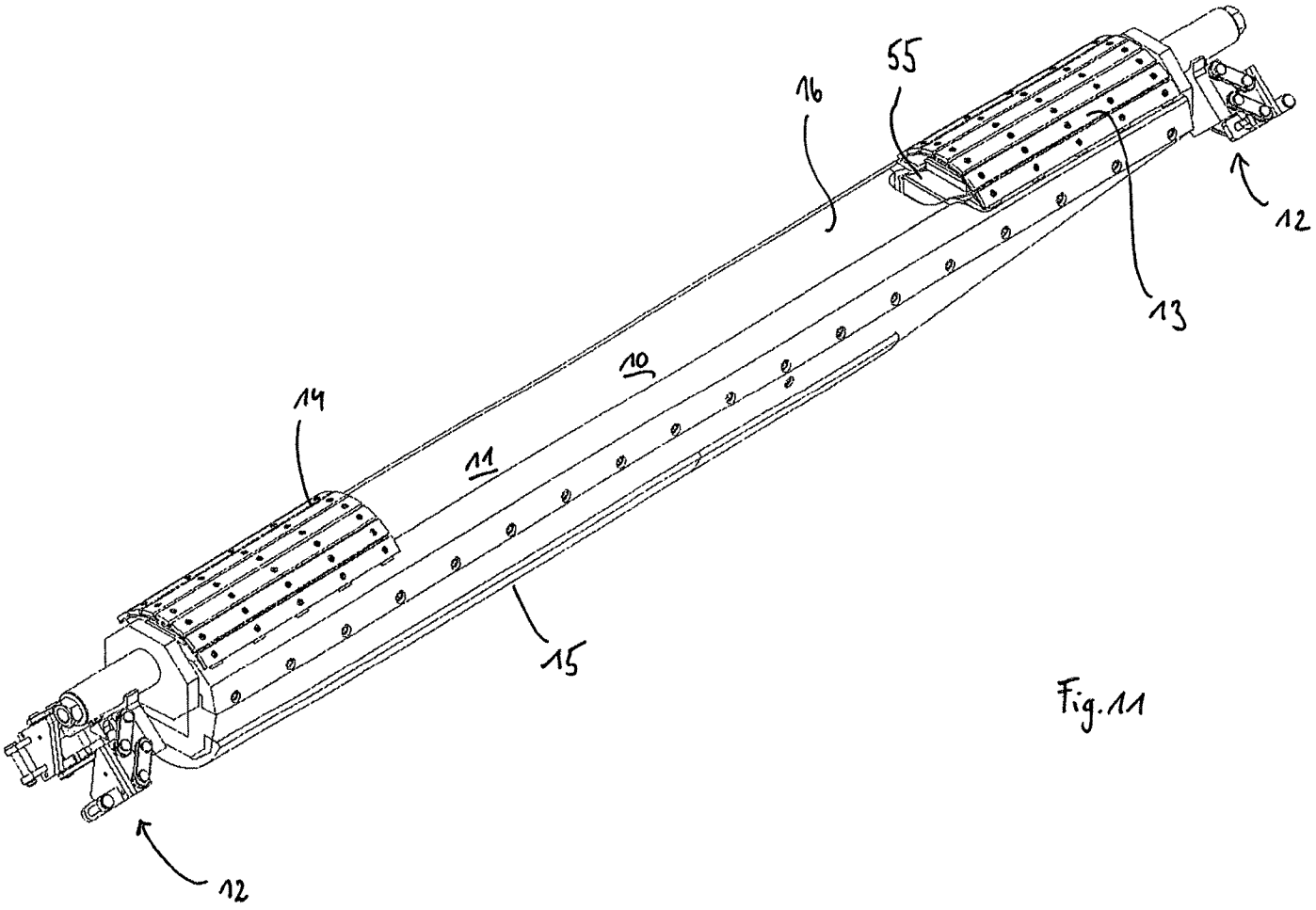
Figure 12:
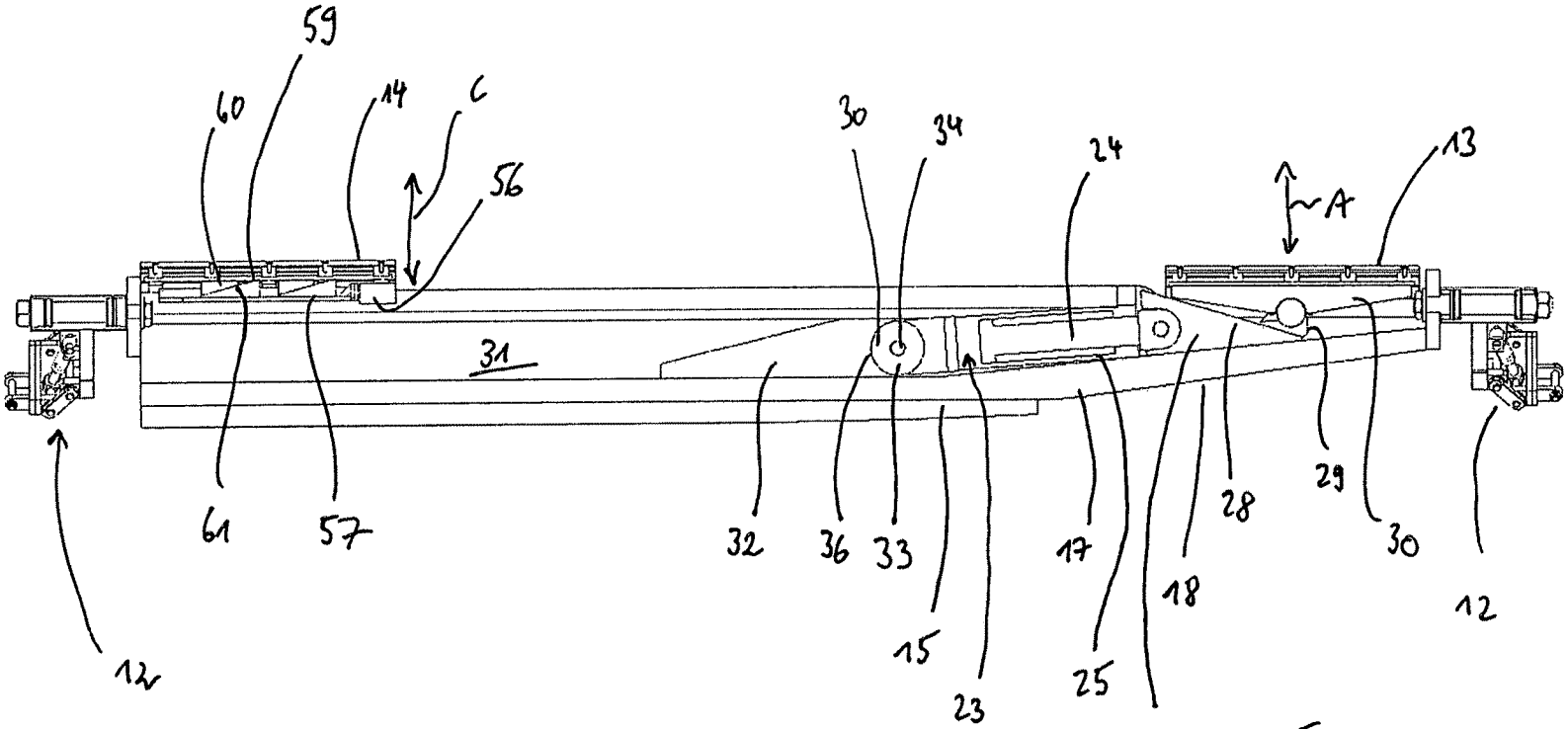

The invention is explained in more detail below by way of several exemplary embodiments by way of a drawing, in which:

FIG. 1 shows a three-dimensional representation of a first embodiment of a device according to the invention, FIG. 2 shows an alternative view to FIG. 1, FIG. 3 shows a part sectioned view of FIG. 1, FIG. 4 shows a view of FIG. 1 sectioned in the longitudinal direction, FIG. 5 shows a view of a detail of the front running gear unit of FIG. 1, FIG. 6 shows a three-dimensional representation of a second embodiment of a device according to the invention, FIG. 7 shows a view of a detail of FIG. 6 with a contact element extended, FIG. 8 shows a view of FIG. 6 sectioned in the longitudinal direction, FIG. 9 shows a view of a detail of the front running gear unit of FIG. 6, FIG. 10 shows a bending operation with a device according to FIG. 6, FIG. 11 shows a three-dimensional representation of a third embodiment of a device according to the invention and FIG. 12 shows a view of FIG. 11 sectioned in the longitudinal direction.

FIGS. 1 to 5 show a first embodiment of a bending device 10 according to the invention. The bending device 10 comprises a basic body 11, on the front and rear end of which in each case a running gear unit 12 is arranged. Two contact elements 13, 14 are provided on the top surface 16 of the basic body 11. The bottom surface 17 of the basic body 11 comprises a bend 18. A contact element 15 is provided centrally on the bottom surface 17. The contact element 13 is realized so as to be movable in the direction of movement A. In order to be able to carry out said movement, the contact element comprises a cantilever arm 19 which connects the contact element 13 to the basic body 11 by means of a pivot point 20. The cantilever arm 19 is connected by means of a second pivot point 21. A path-diverting element 22, which is connected to a force-introducing element 23, is provided below the contact element 13. The force-introducing element 23 is a hydraulic cylinder. The hydraulic cylinder 23 comprises a piston rod 24. Said piston rod is connected to a wedge 27 by means of a pin connection 26 on its side remote from the cylinder chamber 25. The wedge 27 comprises a wedge face 28 on which a second wedge 29 is moveably arranged. The wedge 29 is connected so as to be rotatable to a carrier 30 on which the contact element 13 is arranged. A base 32 is arranged in the interior of the basic body 11. The hydraulic cylinder 23 comprises a bottom cylinder eye 33. Said eye is connected to the basic body 11 by means of a pin connection 34. The cylinder eye 33 comprises an outside face 35. The base 32 comprises a corresponding inside face 36. Between the pin connection 34 and the cylinder eye 33 there is play such that when the hydraulic cylinder 23 is extended, the force is transmitted onto the inside face 36 of the base 32 by means of the outside face 35 on the side of the hydraulic cylinder remote from the contact cylinder 13. The contact element 14 and the contact element 15 are in each case arranged fixedly, but changeably, on the basic body 11.

The running gear unit 12 is realized as follows in this embodiment. A receiving element 38 is arranged on the end face 37 of the basic body 11. A pivot element 39 is rotatably mounted on the receiving element 38. A hinged element 40 is rotatably arranged on the pivot element 39. A hydraulic motor 41, which is connected to a drive shaft 43 by means of a drive pinion 42, is arranged inside the hinged element 40. The drive shaft 43 communicates with the drive wheels 44. The bending device 10 is moved into and out of the pipe by means of the drive wheels 44. It is possible 39 to raise the running gear unit 12 by means of the pivot element 39 such that the contact element 15 comes into contact with the inside wall 102 of the pipe 100 and the drive wheels 44 come off the inside wall 102 of the pipe 100.

FIGS. 6 to 9 show a second embodiment of the bending device 10 according to the invention. A running gear unit 12 is arranged in each case on the front and rear end of the basic body 11. A contact element 13 and a contact element 14 are situated in each case on the front and rear end of the top surface 16. A contact element 15 is fixedly arranged in the center of the bottom surface 17. The bottom surface 17 comprises a bend 18 in the front portion of the running gear unit 12. The front contact element 13 and the rear contact element 14 are connected together by means of two cables 45 as path-limiters and guide means. The design of the path-diverting element 22 and of the force-introducing element 23 corresponds to the first embodiment. As shown in FIG. 7, the contact element 13 is additionally connected to the basic body 11 by means of spring elements 46. The spring elements 46 serve for the purpose of conveying the contact element 13 into its original position again when the hydraulic cylinder 23 is retracted. The front running gear unit 12 comprises a shaft 47, which is arranged on the end face 37 of the basic body 11 in the longitudinal direction of the basic body 11. A sleeve 48 is arranged, rotatably mounted, around the shaft 47. A carrier element 49 is arranged fixedly on the sleeve 48. A hinged element 50 is arranged on the carrier element 49 by means of cantilever arms 51. The hinged element 50 comprises a receiving means 52 for wheels 53. By means of hydraulic cylinders 54, which are connected to the carrier element 49 and the hinged element 50, it is possible to raise the hinged elements such that the wheels 53 are moved away from the inside wall of the pipe, as a result of which the bottom contact element 15 comes to rest on the inside wall of the pipe. In order to have sufficient bending space, the hinged elements 50 are raised by means of the hydraulic cylinders 54 until a sufficient spacing is created between the running gear unit 12 and the inside wall 102 of the pipe such that the pipe 100 is able to be bent upward in a corresponding manner by the desired bend angle.

FIG. 10 shows the use of the bending operation 10 according to a second embodiment when bending a pipe 100. The pipe 100 is composed of a pipeline pipe 103 and a coating 101, for example made of PUR rigid foam. The bending device 10 is moved into the pipe 100. A region 104 of the pipe 100 which has already been bent is shown. The running gear unit 12 of the bending device 10 is retracted such that the contact element 15 comes into contact with the inside wall 102 of the pipeline pipe 103. The contact element 13 is extended by means of the hydraulic cylinder 23 and the path-diverting element 22 by the wedge 27 being moved by the piston rod 24 of the hydraulic cylinder and at the same time the wedge 29 on the wedge face 28 of the wedge 27 being moved upward until the contact element 13 contacts the inside wall 102. As a result of continuing the movement of the piston rod 24, the contact element 13 is then pressed against the inside wall 1012 of the pipe 100 and the pipeline pipe 103 of the pipe 100 experiences a bend. In order to develop said bend in a permanent manner, the elastic deformation of the pipe has first of all to be overcome. Plastic deformation of the pipe then takes place such that a corresponding deformation is carried out. After completion of the bending step, when the corresponding bend angle has been obtained, the piston rod 24 is retracted by means of the hydraulic cylinder, as a result of which the wedge 29 is able to be moved downward from the wedge face 28. As the contact face 13 is prevented by means of the cable 45 from movement other than back into the basic body 11, the contact element 13 is moved back into its original position by means the spring elements 46. The elastic portion of the bending operation is recorded and taken into consideration for precision purposes when controlling the bending.

The running gear unit 12 is then extended again and the bending device 10 can be moved out of the pipe up to the next bending location at which the next bending increment can then be carried out in a corresponding manner.

A third embodiment of the bending device 10 according to the invention is shown in FIGS. 11 and 12. Running gear units 12, which are designed as the running gear unit part 12 of the second embodiment which is situated in the region of the contact element 13, are arranged on both ends of the basic body 11. The contact element 13 is once again arranged so as to be movable by means of a corresponding path-diverting element 22 and a force-introducing element 23. Guide cantilever arms 55 are arranged between the contact element 13 and the basic body 11. The bottom contact element 15 extends along a straight portion of the basic body 11 from the start of the curved portion of the basic body 11 toward the end of the basic body 11, on which the contact element 14 is arranged. The contact element 15, in this case, is arranged fixedly on the bottom surface 17 over the entire length of the straight portion. In this embodiment, the contact element 14 can be moved away from the basic body 11 in the direction of movement C. A hydraulic cylinder 56, which is connected to a sliding element 57 on which wedges 58 are arranged, is provided for this purpose. The contact element 14 is arranged on a carrier element 59. Wedges 60, which are arranged so as to be displaceable on a wedge face 61 of the wedges 58, are arranged on the bottom surface of the carrier element 59. If the hydraulic cylinder 56 is extended, the wedges 58 are moved in relation to the wedges 60 such that the wedges 60 are displaced along the wedge faces 61 in the direction of movement C such that the contact element 14 is moved against the inside wall 102 of the pipe 100. The contact element 14 is extended until it contacts the inner wall 102. As a result, the end of the bending device 10, which points to the part of the pipe 100 which has not yet been bent, is wedged inside the pipeline pipe 103 and as a result is locked. The contact element 13 is then extended by means of the hydraulic cylinder 23 and the path-diverting element 22 in the direction of movement A until the contact element 13 reaches the inside wall 102 of the pipeline pipe 102 and contacts the same. The pipe is then bent as described beforehand.

| List of references | |
|---|---|
| 10 | Bending device |
| 11 | Basic body |
| 12 | Running gear unit |
| 13 | Contact element |
| 14 | Contact element |
| 15 | Contact element |
| 16 | Top surface |
| 17 | Bottom surface |
| 18 | Bend |
| 19 | Cantilever arm |
| 20 | Pivot point |
| 21 | Pivot point |
| 22 | Path-diverting element |
| 23 | Force-introducing element/hydraulic cylinder |
| 24 | Piston rod |
| 25 | Cylinder chamber |
| 26 | Pin connection |
| 27 | Wedge |
| 28 | Wedge face |
| 29 | Wedge |
| 30 | Carrier |
| 31 | Interior |
| 32 | Base |
| 33 | Cylinder chamber |
| 34 | Pin connection |
| 35 | Outside face |
| 36 | Inside face |
| 37 | End face |
| 38 | Receiving element |
| 39 | Pivot element |
| 40 | Hinged element |
| 41 | Hydraulic motor |
| 42 | Drive pinion |
| 43 | Drive shaft |
| 44 | Drive wheel |
| 45 | Cable |
| 46 | Spring element |
| 47 | Shaft |
| 48 | Sleeve |
| 49 | Carrier element |
| 50 | Hinged element |
| 51 | Cantilever arm |
| 52 | Receiving means |
| 53 | Wheel |
| 54 | Hydraulic cylinder |
| 55 | Guide cantilever arm |
| 56 | Hydraulic cylinder |
| 57 | Sliding element |
| 58 | Wedge |
| 59 | Carrier element |
| 60 | Wedge |
| 61 | Wedge face |
| 100 | Pipe |
| 101 | Coating |
| 102 | Inside wall |
| 103 | Pipeline pipe |
| 104 | Bent region |
| A | Direction of movement |
| B | Direction of movement |
| C | Direction of movement |

The invention claimed is:

1. A device for bending pipes, including coated pipes, including insulated pipes and pipes that are coated with at least one of PU foam and PUR rigid foam, for pipelines, said device having a basic body, which can be positioned in the pipe and on which a running gear unit produces movement in the pipe, said running gear unit comprising a running gear unit basic body which is rotatable in relation to the basic body, wherein the running gear unit comprises a front and a rear running gear unit and the rotational axes of the running gear unit bodies of the running gear units extend coaxially, wherein the rotational axis is situated above a center of gravity of at least one of the device and of the running gear unit, and wherein the running gear unit is arranged in such a manner on the basic body that the basic body is rotatable in relation to the running gear unit and wherein the direction of rotation is substantially perpendicular with reference to the direction of travel, and having at least first, second, and third contact elements for producing a contact with an inside wall of the pipe for introducing a bending force, wherein at least two contact elements are provided on one side of the basic body on the ends of the basic body, and at least one contact element is arranged on the opposite side of the basic body, and wherein the first contact element is provided so as to be movable in relation to the basic body in the direction of the inside wall of the pipe by means of a force-introducing element, the force-introducing element is arranged substantially horizontally with the force introduced horizontally, and a path-diverting element is configured to allow the horizontally introduced force to produce a substantially vertical movement of the first contact element toward the inside wall of the pipe.

2. The device according to claim 1, wherein the second contact element is movable in relation to the basic body in the direction of the inside wall of the pipe by means of a force-introducing element and wherein the third contact element is provided on the basic body on the opposite side to the second contact element, integral with the second contact element which extends up to the end of the basic body on which the second contact element is arranged.

3. The device according to claim 1, wherein the path-diverting element comprises a wedge-shaped element and an element, which corresponds to the wedge-shaped element on the movable contact element and is movable on the wedge-shaped element.

4. The device according to claim 1, wherein the first contact element is movably connected to the basic body by means of a connecting element which is pivotally and rotatably mounted on the contact element by at least one of a cantilever arm or a steel cable, and the connecting element is pivotally and rotatably mounted on the basic body, with at least one return element, including a spring element, provided between the first contact element and the basic body.

5. The device according to claim 1, wherein on one side of the force-introducing element opposite the path-diverting element, on the force-introducing element and on the basic body, a pressing face is configured as an abutment for applying force, wherein the pressing faces come into contact when force is introduced, and the force-introducing element includes a hydraulic cylinder.

6. The device according to claim 1, wherein the running gear unit comprises a running body, which comprises wheels for advancing the device in the pipe and which is movable in relation to the running gear unit basic body to the rotational axis of the running gear unit basic body, by means of at least one hydraulic cylinder.

* * * * *